United States Patent [19]

Buehler

[11] 3,991,400

[45] Nov. 9, 1976

[54] TRAFFIC LIGHT HOUSING

[75] Inventor: Amsey Buehler, Cobourg, Canada

[73] Assignee: Canadian General Electric Company Limited, Toronto, Canada

[22] Filed: July 18, 1975

[21] Appl. No.: 597,241

[52] U.S. Cl. ..... 340/119; 340/84; 174/52 R

[51] Int. Cl.[2] ..... E01F 9/00

[58] Field of Search ..... 340/119, 84, 74; 240/52 R, 2 R; 174/52 R, 61

[56] References Cited

UNITED STATES PATENTS

| | | | |
|---|---|---|---|
| 2,970,289 | 1/1961 | Loomis | 340/11 G |
| 3,706,070 | 12/1972 | Eikenberry | 340/11 G |

*Primary Examiner*—John W. Caldwell
*Assistant Examiner*—William M. Wannisky

[57] ABSTRACT

A traffic signal housing particularly suitable for moulding modular units frm engineering thermoplastics. The back body portion is generally cylindrical; each end portion of the cylinder is reinforced with radial webbing connecting to a coaxial inner cylinder, thus forming a stiff load transfer structure extending into the housing to a depth of about 10 percent. The peripheral edges of a one load transfer structure are shaped to mate and seal with those of an adjacent unit. Units are coupled with a pipe bolt passing through adjacent inner cylinders to place the reinforced ends under compression. Thus assembled units have a great rigidity and load may be transmitted without the undue flexing or cracking common in prior known units.

12 Claims, 4 Drawing Figures

TRAFFIC LIGHT HOUSING

This application concerns traffic signals, particularly those of a modular unit type, several of which may be interconnected to provide sequential traffic signalling. More particularly it concerns the body or housing for these units.

Such housings have previously been produced from metal castings; more recently attempts have been made to manufacture them from thermoplastic materials, particularly polycarbonates, by injection moulding. Of particular interest is a moulded unit described by Eikenberry in U.S. Pat. No. 3,706,070, Dec. 12, 1972.

The known traffic signal housings are essentially open fronted box structures having side walls, back wall and top and bottom walls. The side walls may be angulated and blended to join into the back wall in order to reduce the exposed surface area. Modular units assembled from these housings are top or bottom mounted, and interconnected from respective top and bottom walls. Where the walls are metallic they have sufficient inherent rigidity to transmit requisite loadings without being overstressed. With known plastic units however, considerable deformation of the top and bottom walls takes place and the walls are subject to failure by cracking particularly adjacent to the points of mounting and interconnection. Various proposals have been made to overcome or reduce this defect; thus large flat metal washers or plates have been used to support the top and bottom walls, or the walls have been moulded in excessively thick sections; Eikenberry shows a strengthening ribbing upon the top and bottom walls. However the problem still remains and the full benefits of utilizing thermoplastic materials have not yet been attained.

It is a prime object of my invention to provide modular traffic signal units and housings therefore which may be constructed in thermoplastic materials and suspended and mounted in a conventional manner whilst reducing the tendency to fail by cracking and to deform. Other objects and advantages of my invention will be disclosed, and further advantages will be apparent to those skilled in the art.

The traffic signal housings of my invention are formed with a stiff annular structure at each end of the housing; these structures have complementary mating surfaces so that two units may be coupled together and a load transmitted therebetween through these mating surfaces. The stiff, annular load transfer structures occupy a major portion of the ends of the traffic signal housing; desirably the traffic signal housing has a cylindrical body portion which is coincident with and forms one annular member of the load transfer structure.

My invention will be particularly described with reference to a preferred embodiment thereof which is illustrated in the accompanying figures wherein FIG. 1 shows a traffic signal comprising three modular units coupled together and suspended from a boom;

Figures 1, 2:
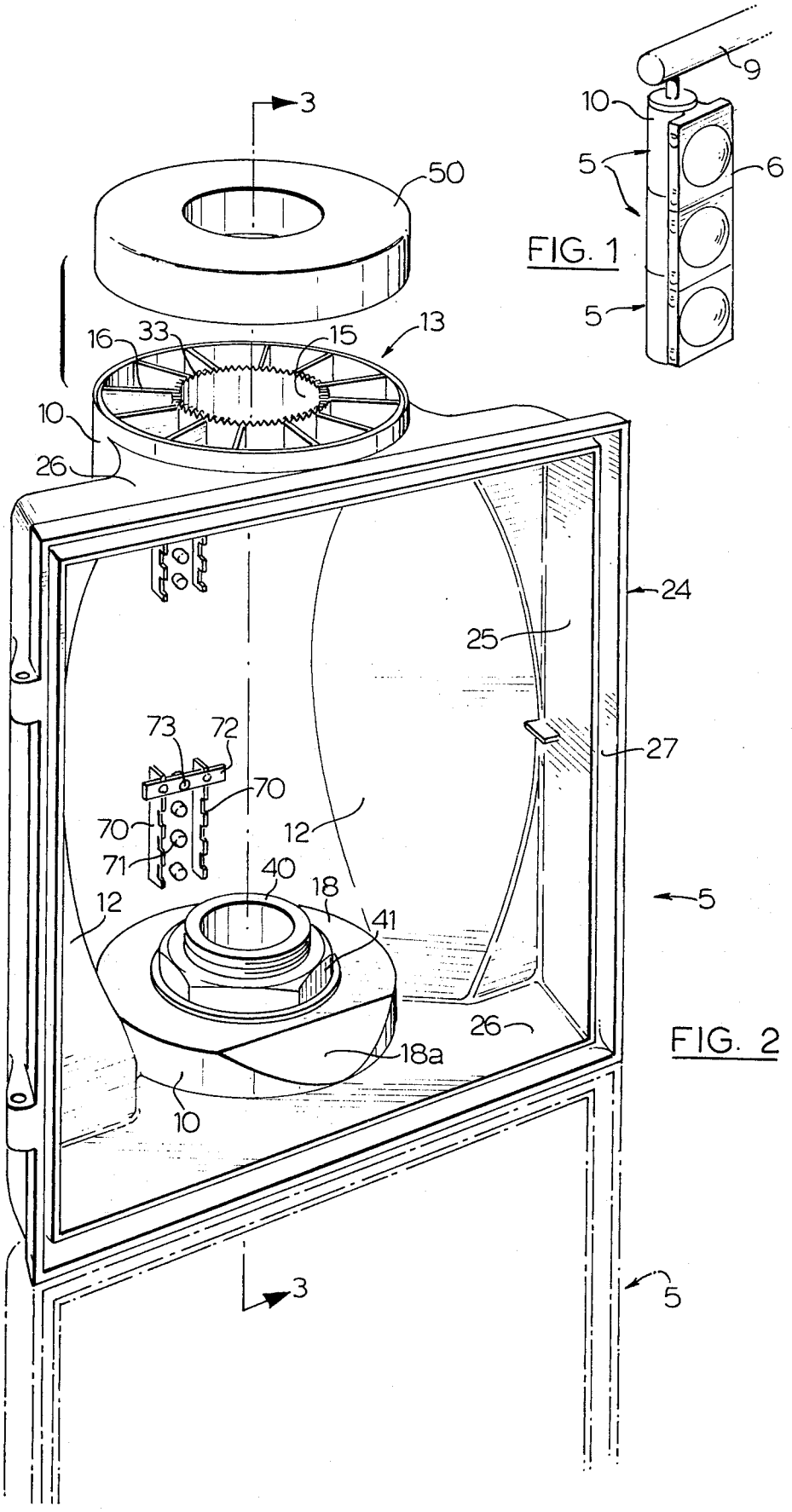
FIG. 2 shows a frontal perspective view looking into one of the traffic housings used to construct the assembly of FIG. 1.

Referring to FIG. 1, the traffic signal units may be seen to comprise a plurality of housings 5 each having a door 6 hinged and secured thereto; each housing 5 includes a cylindrical back portion 10; the coupled cylinder portions of adjacent units form an essentially continuous cylindrical structure wherein compressive axial loadings may be readily transmitted from end to end. Whilst metallic parts are used to interconnect the units, as will be explained further in more detail, these are all contained within the housings, promoting an aesthetic appearance and also reducing the amount of necessary maintenance. Although the traffic signal is shown as being mounted through the upper unit to a boom 9, other traditional methods of mounting may also be used, as will be apparent.

Figure 3:
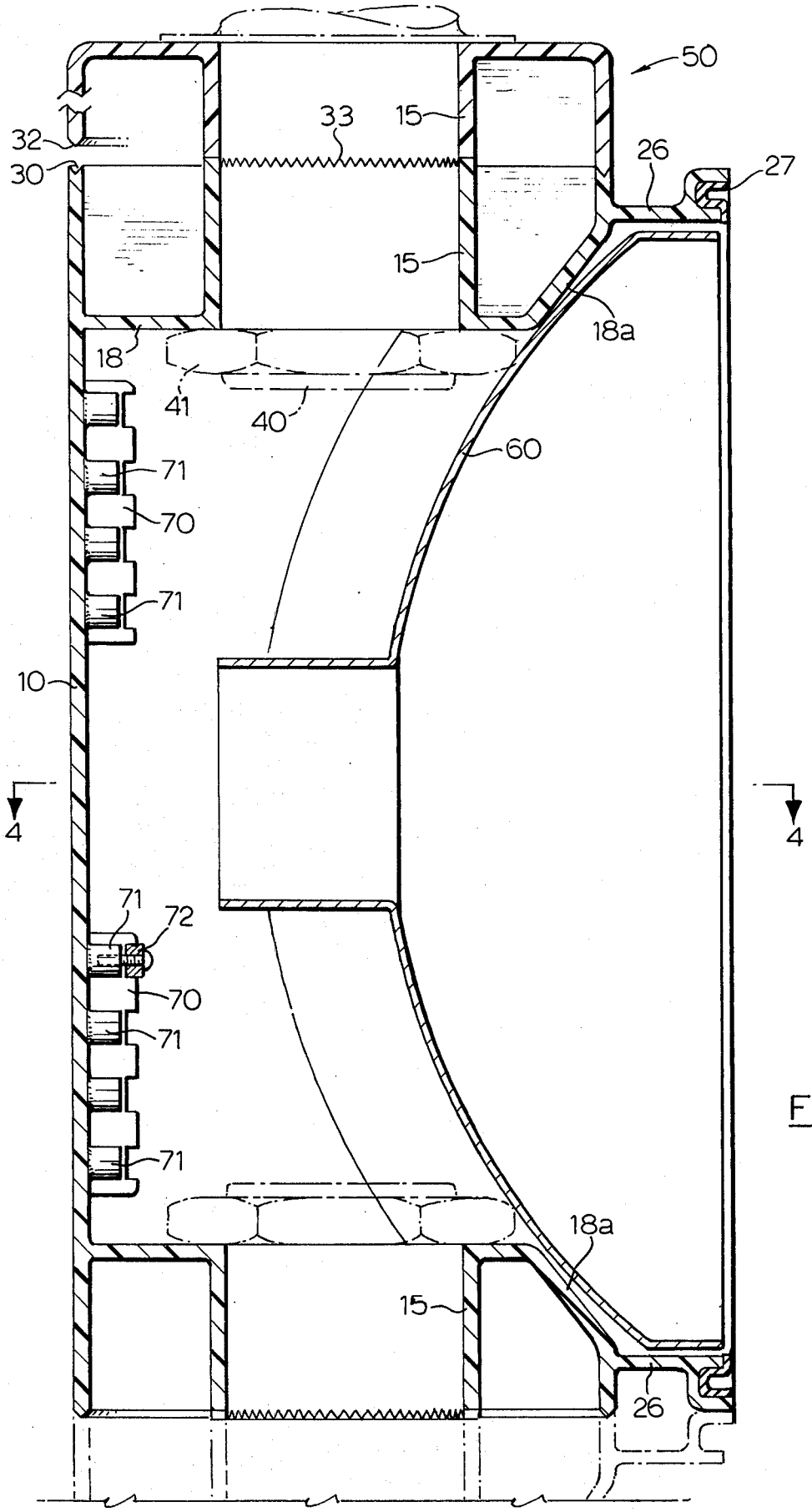
FIG. 3 is a sectional view of the housing taken at 3—3 of FIG. 2.
Figure 4:
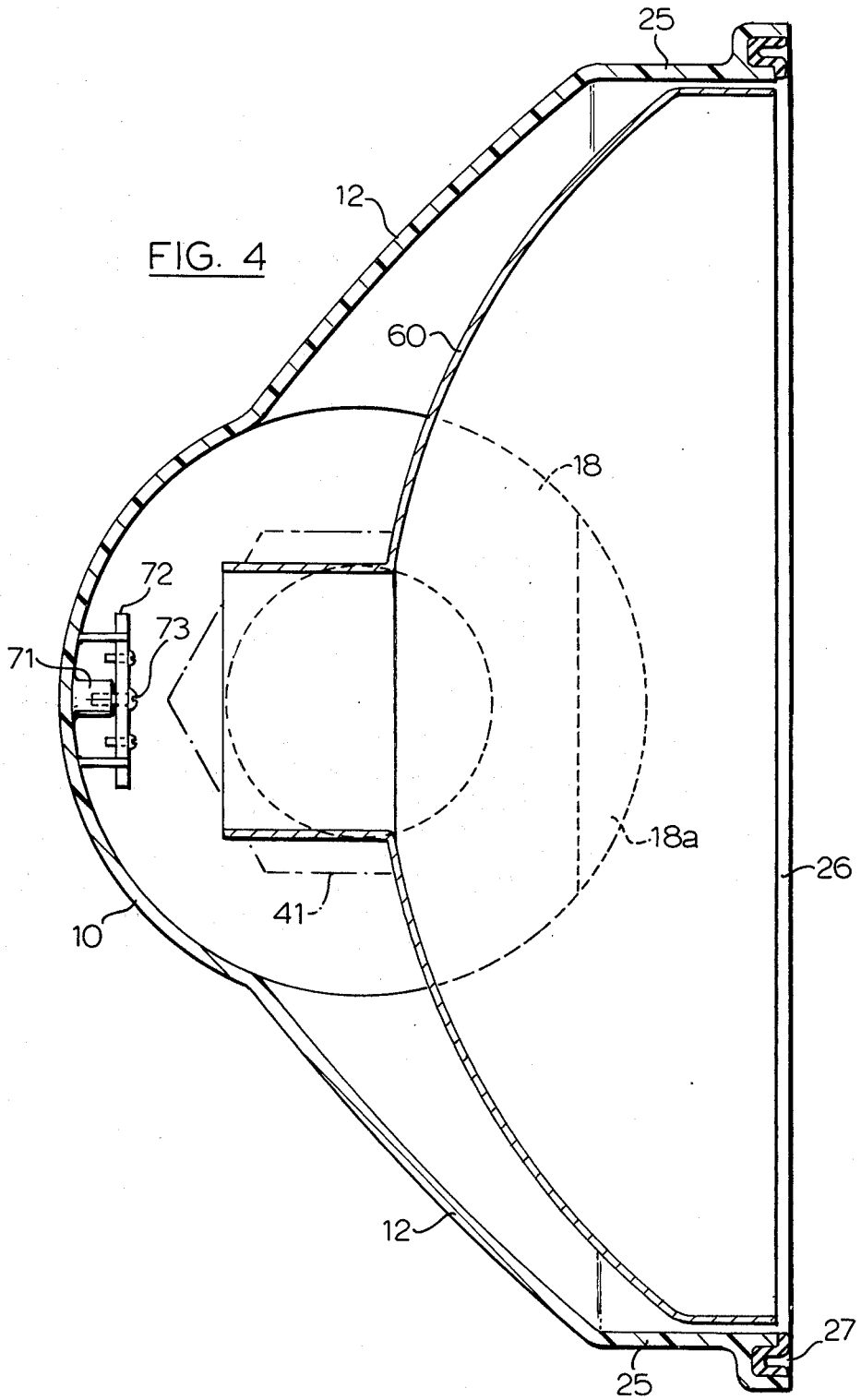
FIG. 4 is a sectional view at 4—4 of FIG. 3.

Referring to FIGS. 2–4, cylindrical body portion 10 of housing 5 has a forward opening therein defined in part by inwardly concave side walls 12 which intersect with the body portion 10 along arcuate juncture lines to provide additional strength and stiffness to the housing. The juncture lines will preferably not be forward of a plane parallel to door 6 and containing the cylinder axis in order to avoid mould under cutting where the housing is desired to be formed in a moulding operation. At each end of body portion 10 is formed a load transfer structure 13 which comprises an outer annulus, in this case coincidental with cylindrical body portion 10, an inner annulus 15, and stiffening means interconnecting the annuli. As illustrated, the stiffening means comprises a longitudinally extending cellular structure, each cell portion having preferably radial webs 16 and axial closure wall portions 18, 18*a*, to form large, open cells. Axial closure wall portions 18, 18*a* provide both a stiffening function and a sealing function. As described wherein the closure wall portions define the inner limit of load transfer structure 13 the cells open outwardly. However the axial closure wall could equally be formed adjacent to the outer end of load transfer structure 13 or at a position intermediate the inner and outer ends. Also, other forms of stiffening between the annuli are contemplated, particularly those having a cellular structure resulting from in situ foaming of plastic materials possessing high compressive strength.

A rectangular door frame structure 24, including axially extending side portions 25, transversely extending end portions 26 and canalar rim portions 27, is molded to body portion 10, with inwardly concave sidewalls 12 integrally connected with associated portions of side walls 25, and end wall portions 26 moulded to body portions 10 adjacent the end thereof to form a unitary structure. Since it will be normally desired that units be directly coupled together, the axial separation of the canalar rim 27 is normally less than the length of body portion 10, in order that adjacent units may mate on mating surfaces provided in the annular load transfer structures. As illustrated, the outward facing peripheral edge of each annular comprising the load transfer structure is contoured that of the outer annulus being V grooved, 30, at the upper end, and V tongued, 32, at the lower end (with specific reference to FIG. 3), thereby providing a stabilized sealing and loading transfer surface. The axially outer peripheral edge of each inner annulus 15 has a dentate structure with a plurality of teeth 33 to provide an indexable load transfer surface. The teeth on one edge are normally peripherally displaced by a tooth half pitch relative to the teeth of a mating edge in order to ensure a precise planar frontal relationship between adjacent coupled units. It will be evident that composite signal light units may be assembled facing in more than one direction.

In order to develop sufficient stiffness in the individual load transfer structures 13 and to ensure that the stress levels created by load transmittance between units remains low, it will normally be preferred that the transfer structure be maintained as deep as possible in an axial sense, usually having a depth at least equal to 70% of the height of the signal unit and preferably at least about 1 inch, although the actual depth will be dependent to some extent upon design factors such as materials of construction and wall thicknesses etc. However there are certain spatial limitations which usually limit the depth of structure 13. Thus, it is preferred that the signals be generally interchangeable with those of the art, thereby limiting the length of body portion 10. It is also preferred to employ standard optical equipment within the housing and the reflector, shown as 60, is particularly demanding of space, for its frontal diameter may be up to 90% of the length of body portion 10. Also it is preferred to limit the front to back depth of housing 5 in order to reduce unsupported wall structures such as wall portions 26 to a minimum and also to reduce the exposed surface area of the housing. A compromise solution was reached in the housing illustrated by making load transfer structure 13 penetrate well within the interior of housing 5, and cutting away in a chamfer those portions which interfere with the fitting of reflector 60. Portion 18*a* of axial closure wall 18 seals over this chamfer.

Adjacent units assembled from the housings described are coupled together by using a pipe bolt 40 and nuts 41, inner annulus 15 providing a passage to receive the pipe bolt 40. The assembled units are placed under a compressive load by tightening nuts 41, to generate precompression in the respective load transfer structures 13, together with a tight seal across mating surfaces 30–32. The mating surfaces illustrated provide a greater interfacial contact area for load transmittance than uncontoured faces, hence the precompression can be somewhat higher; also the complementary contoured faces provide a positive location of the faces, the one being received in the other thereby reducing the tendency of the faces to buckle when placed under compressive load. When a bending moment is applied the respective housings 5 across the coupling, the tensile component thereof will tend to open mating surfaces 30–32 and destroy the seal in that area. However the initial precompression exceeds any such tensile component that is normally generated; in the event that the tensile component is greater than the precompression, before the mating surfaces 30, 32 can open the bending forces will be transmitted to pipe bolt 40 via the component parts of stiff structure 13, thus preserving the weather tightness of the seal.

One or more units may be rigidly mounted to a boom, for example as in FIG. 1, in a manner analogous to that in which the units are coupled together. For mounting purposes a load transfer structures 13 may be separately formed into a suspension and closure cap 50, best seen in FIGS. 2 and 3. The structure of the cap is generally identical and complementary to that of one load transfer structure built into housing 5, although there will be no necessity to chamfer any portion of the suspension cap.

In simulated wind load tests three housings constructed from a thermoplastic resin essentially as described and illustrated were interconnected and rigidly suspended from the top unit, using a cap 50 and intermediate pipe bolts having a nominal diameter of 2 inches. A tensile force was applied at the middle of each body cylinder normal to the axis thereof, the forces acting in concert. Loading was gradually increased upon each unit until it was representative of a wind velocity of about 100 m.p.h., there was no evidence of flexing or of the housings being overstressed in the critical joint areas, neither was there evidence of mating surfaces 30–32 opening to destroy the seal across those surfaces.

A significant advantage of the traffic signal units of my invention is that body loadings can be transmitted through the couplings with a constant efficiency and the seal maintained irrespective of the relative orientation of the respective units and regardless of the wind direction. A traffic signal combination may therefore comprise forward, sideways and rearward facing units if desired and function without sacrifice of efficiency. The desired relative rotations will be maintained by indexing teeth 33 formed upon inner annuli 15.

In the formation of traffic signal assemblies it is often desirable to give more visual emphasis to one signal than need be given to the others. Typically, in a set of redamber-green lights the red signal may have a 10 inch lens whereas the amber and green signals may require only an 8 inch lens. For reasons of economy the smaller lens will normally be contained in a smaller housing than that of the larger lens. However I find that housings for both the 8 inch and 10 inch lens may be constructed wherein cylindrical back portions 10 have the same diameter for both sizes of housings, hence these housings having load transfer structures constructed as described may be coupled together without difficulty. Should it be desired to coupled together units wherein there is a significant difference in body size necessitating different diameters for the cylindrical back portions 10, my invention further contemplates the formation of stiff load transfer structures having a multiplicity of coaxial walls of predetermined spacing. Generally speaking, inner annulus 15 will always have the same diameter, and concentric outer annuli of predetermined increased diameter may be formed thereabout. Such multiple wall load transfer structures may be formed integrally with the larger housing essentially as described, or they may be provided separately as an adaptor ring.

The traffic signal housings have previously been spoken of as having a load transfer structure 13 built into each end in order that units may be coupled together. Of course, in many instances it will be desired merely to suspend one unit, hence the load transfer structure in such instances need be incorporated only into the one end.

Whilst body portion 10 of the traffic signal units described has been referred to as being cylindrical and illustrated as a right circular cylindrical body portions, this being a preferred form, many variations from this are envisaged. It will be generally preferred that load transfer structure 13 should occupy a major proportion of what might be thought of as the end wall of the traffic signal housing in order to reduce unsupported or poorly supported wall spans common in the prior art.

The various optical and other components that are employed in the construction of the modular traffic signal will be known to those in the art and they will not be particularly described. They may be assembled into housing 5 in any manner that is convenient. The invention does contemplate the provision of an integral terminal structure as an aid to the facile wiring of the units. One completed unit of the terminal structure may be seen in FIG. 2 and this comprises raised portions moulded onto the interior wall of cylinder 10 including opposed crenelated walls 70 and central portion 71; a terminal plate 72, which may be screwed or provided with spade connector lugs or other terminal means, is located in the crenelations of walls 70 and affixed to cenral portion 71 by screw 73.

What I claim as new and desire to secure by Letters Patent of the United States is:

1. In a traffic signal unit wherein the housing therefor comprises a body portion having a longitudinal axis and including a planar door frame parallel to said axis opening from said body portion to provide access within said housing, the improvement wherein at least one axial end of said body portion is provided with a load transfer structure comprising an outer annulus substantially coextensive with the end of said body portion, an annulus coaxial with said outer annulus and connected thereto by means to stiffen said structure, and mating connection means formed on said annuli to mate with complementary means formed on an adjacent said structue.

2. A traffic signal unit as claimed in claim 1 wherein said outer annulus is coincidental with the adjoining end of said body portion.

3. A traffic signal unit as described in claim 2 wherein each axial end of said housing is provided with said load transfer structure.

4. A traffic signal unit as described in claim 3 wherein said door frame is connected to said body portion by walls including inwardly concave side walls which intersect said body portion at arcuate junctures to stiffen said unit.

5. A traffic signal unit as described in claim 2, wherein said inner and outer annuli are interconnected by load transfer web means.

6. A traffic signal unit as described in claim 2, wherein said load transfer structure has a depth equal to at least about 70% of the axial length of said housing.

7. In a traffic signal unit the improvement wherein the housing therefore comprises a cylindrical body portion, a planar door frame opening therefrom to give access within said housing, the plane of said door frame being parallel to the axis of the cylinder of said cylindrical body portion, at least one end of said cylinder a load transfer structure comprising the wall of said cylinder, an inner annulus coaxial therewith and connected thereto by stiffening web means, and mating means formed on the end periphery of said cylinder wall and the outer end periphery of said annulus to mate with complementary means formed on an adjacent said structure.

8. A traffic signal unit as described in claim 7 wherein said door frame is connected to said cylindrical body portion by wall means including inwardly concave side walls which connect with said body portion along arcuate paths to stiffen said body portion.

9. A traffic signal unit as described in claim 8 wherein said transfer structures are formed at each end of said unit.

10. A traffic signal unit as described in claim 7, wherein said adjacent mating means comprises complementary V tongues and V grooves formed adjacent said cylinder end peripheries and dentate indexing means formed adjacent said annulus outer end peripheries.

11. A traffic signal unit as described in claim 4, moulded in a polycarbonate resin.

12. A traffic signal unit as described in claim 7 moulded in polycarbonate resin.

* * * * *